US011235208B2

(12) United States Patent
Yamamoto

(10) Patent No.: US 11,235,208 B2
(45) Date of Patent: Feb. 1, 2022

(54) GOLF CLUB HEAD

(71) Applicant: Sumitomo Rubber Industries, Ltd., Hyogo (JP)

(72) Inventor: Akio Yamamoto, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/710,907

(22) Filed: Dec. 11, 2019

(65) Prior Publication Data

US 2020/0206586 A1 Jul. 2, 2020

(30) Foreign Application Priority Data

Dec. 27, 2018 (JP) ..... JP2018-245359

(51) Int. Cl.
*A63B 53/00* (2015.01)
*A63B 53/04* (2015.01)

(52) U.S. Cl.
CPC ..... *A63B 53/0466* (2013.01); *A63B 53/0408* (2020.08); *A63B 2053/0491* (2013.01)

(58) Field of Classification Search
CPC ..... A63B 53/0433; A63B 2053/045
See application file for complete search history.

(56) References Cited

U.S. PATENT DOCUMENTS 6,254,494 B1 * 7/2001 Hasebe ..... A63B 53/0466 473/349
6,296,576 B1 * 10/2001 Capelli ..... A63B 53/04 473/326
6,945,877 B2 * 9/2005 Kobayashi ..... A63B 60/00 473/345
7,004,852 B2 * 2/2006 Billings ..... A63B 53/0466 473/332
7,258,626 B2 * 8/2007 Gibbs ..... A63B 53/02 473/329
8,257,195 B1 * 9/2012 Erickson ..... A63B 60/02 473/329
8,328,661 B1 * 12/2012 Erickson ..... A63B 53/04 473/329
8,636,610 B2 * 1/2014 Golden ..... A63B 60/00 473/349
8,900,070 B1 * 12/2014 Dawson ..... A63B 53/047 473/329

(Continued)

FOREIGN PATENT DOCUMENTS

JP 5982555 B2 8/2016
WO 2013158146 A1 10/2013

*Primary Examiner* — Eugene L Kim
*Assistant Examiner* — Matthew B Stanczak
(74) *Attorney, Agent, or Firm* — Studebaker & Brackett PC

(57) ABSTRACT

A golf club head having a hollow portion therein includes a face portion for striking a ball and defining a leading edge, a sole portion extending rearwardly of the club head from the face portion and having an inner surface thereof facing the hollow portion, a club head thickness being equal to or less than 39.0 mm. The sole portion is provided on the inner surface with a weight portion extending along the leading edge and a thin wall region between the leading edge and the weight portion. The thin wall region has a length L of from 14.0 to 23.0 mm in a head front-rear direction. The thin wall region has a ratio t/L of a maximum thickness t (mm) thereof to the length L (mm) is in a range of from 0.040 to 0.080.

22 Claims, 10 Drawing Sheets

(56) References Cited

U.S. PATENT DOCUMENTS 8,926,448 B1* 1/2015 Ivanova ..... A63B 60/52 473/329
9,211,451 B1* 12/2015 Westrum ..... A63B 60/00
9,687,701 B1* 6/2017 Seluga ..... A63B 60/00
9,782,642 B1* 10/2017 DeMille ..... A63B 53/0475
9,802,084 B2* 10/2017 Shimahara ..... A63B 53/04
9,802,086 B2* 10/2017 Kato ..... A63B 53/0466
9,839,817 B1* 12/2017 Johnson ..... A63B 60/02
10,343,031 B1* 7/2019 Day ..... A63B 53/0466
11,065,511 B2* 7/2021 Aramaki ..... B23K 26/22
2003/0034142 A1* 2/2003 Bliss ..... A63B 53/0466 164/76.1
2006/0172818 A1* 8/2006 Yamamoto ..... A63B 53/0466 473/345
2007/0129167 A1* 6/2007 Matsunaga ..... A63B 53/0466 473/345
2008/0176674 A1* 7/2008 Horacek ..... A63B 53/0466 473/349
2010/0048324 A1* 2/2010 Wada ..... A63B 53/0466 473/346
2010/0120556 A1* 5/2010 Yamamoto ..... A63B 53/0466 473/346
2011/0021289 A1* 1/2011 Yokota ..... A63B 53/0466 473/346
2011/0151989 A1* 6/2011 Golden ..... A63B 53/0466 473/290
2011/0177881 A1* 7/2011 Hayase ..... A63B 53/0466 473/346
2011/0312440 A1* 12/2011 Wada ..... A63B 53/0466 473/346
2012/0142450 A1* 6/2012 Wada ..... A63B 53/06 473/345
2012/0142452 A1* 6/2012 Burnett ..... A63B 53/04 473/345
2012/0252601 A1* 10/2012 Thomas ..... B23C 3/28 473/345
2012/0302368 A1* 11/2012 Nishio ..... A63B 53/04 473/345
2012/0302369 A1* 11/2012 Ban ..... A63B 53/04 473/346
2012/0322580 A1* 12/2012 Wada ..... A63B 60/002 473/346
2013/0130831 A1* 5/2013 Morales ..... A63B 60/02 473/345
2013/0130832 A1* 5/2013 Morales ..... A63B 60/02 473/345
2013/0210542 A1* 8/2013 Harbert ..... A63B 53/06 473/338
2013/0316848 A1* 11/2013 Burnett ..... A63B 60/52 473/345
2014/0106903 A1* 4/2014 Nakamura ..... A63B 60/54 473/346
2015/0065265 A1* 3/2015 Motokawa ..... A63B 53/06 473/335
2015/0094163 A1* 4/2015 Motokawa ..... A63B 53/04 473/329
2015/0265885 A1* 9/2015 Hettinger ..... A63B 53/04 473/291
2015/0273290 A1* 10/2015 Motokawa ..... A63B 53/0466 473/346
2016/0114228 A1* 4/2016 Jertson ..... A63B 53/0466 473/350
2016/0250525 A1* 9/2016 Motokawa ..... A63B 60/04 473/336
2017/0050091 A1* 2/2017 Shimahara ..... A63B 53/0466
2018/0161645 A1* 6/2018 Yoshida ..... A63B 53/0466
2018/0185714 A1* 7/2018 Jertson ..... A63B 53/0466
2019/0022472 A1* 1/2019 Del Rosario ..... A63B 53/0437
2019/0255393 A1* 8/2019 Mizutani ..... A63B 53/04
2019/0290972 A1* 9/2019 Del Rosario ..... A63B 53/02
2020/0094116 A1* 3/2020 Kato ..... B21K 17/00

* cited by examiner

GOLF CLUB HEAD

BACKGROUND ART

Field of the Disclosure

The present disclosure relates to a golf club head, more particularly to a golf club head having a hollow portion therein.

Description of the Related Art

In order to increase distance of a struck ball, it has been requested that hollow golf club heads, especially golf club heads called fairway woods or hybrids which have a lot of chances striking a ball placed directly on the turf have a low sweet spot height.

The following Patent document 1 discloses a fairway wood type golf club head. The golf club head includes a metal body including a crown, a sole, a hosel, a cavity, a frontal opening, and a protrusion, and a metal face component including a striking face and a return portion.

PATENT DOCUMENT

[Patent document 1] Japanese Patent 5982555

SUMMARY OF THE DISCLOSURE

As to golf club heads having a relatively small head thickness such as fairway woods and hybrids, the inventor made a lot of studies of improving repulsion performance without impairing durability. As a result, the inventor has found that it is important to provide a weight portion extending along a leading edge on an inner surface of a sole portion of a golf club head and a thin wall region between the weight portion and the leading edge, wherein the thin wall region has the maximum thickness associated with a length of the thin wall region in a head front-rear direction.

The present disclosure has been made in view of the above problem and has a major object to provide a golf club head, especially a golf club head being suitable for a fairway wood and hybrid, capable of improving repulsion performance of a lower position of a face portion without impairing durability.

According to one aspect of the disclosure, a golf club head having a hollow portion therein, the golf club head including a face portion for striking a ball, the face portion defining a leading edge, a sole portion extending rearwardly of the club head from the face portion, the sole portion having an inner surface thereof facing the hollow portion, and a club head thickness being equal to or less than 39.0 mm; wherein the sole portion is provided on the inner surface with a weight portion extending along the leading edge and a thin wall region between the leading edge and the weight portion, the thin wall region has a length L of from 14.0 to 23.0 mm in a head front-rear direction, and the thin wall region has a ratio t/L of a maximum thickness t (mm) thereof to the length L (mm) is in a range of from 0.040 to 0.080.

In another aspect of the disclosure, the maximum thickness t of the thin wall region may be in a range of from 0.6 to 1.8 (mm).

In another aspect of the disclosure, the maximum thickness t of the thin wall region may be in a range of from 0.6 to 1.4 mm.

In another aspect of the disclosure, the maximum thickness t of the thin wall region may be in a range of from 0.6 to 1.1 mm.

In another aspect of the disclosure, the weight portion may extend upwardly from the inner surface of the sole portion such that the weight portion protrudes toward the face portion without contacting with the face portion.

In another aspect of the disclosure, the weight portion may be formed by a thick wall portion of the sole portion.

In another aspect of the disclosure, the golf club head may have a weight of from 190 to 240 g.

In another aspect of the disclosure, the golf club head may have a head width which is a maximum length in the head front-rear direction of the club head is in a range of from 60 to 90 mm.

In another aspect of the disclosure, the golf club head may have a sweet spot height equal to or less than 22 mm.

DESCRIPTION OF THE PREFERRED EMBODIMENTS

Figure 1:
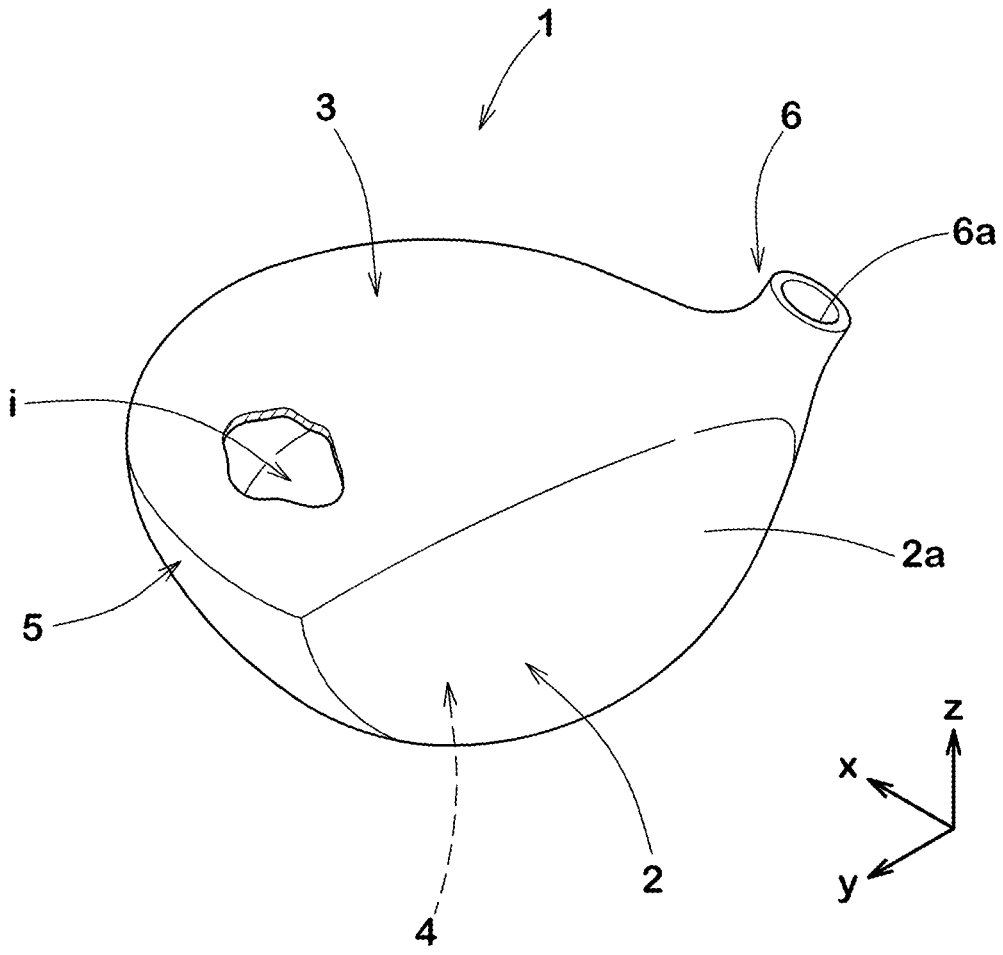
FIG. 1 is a perspective view of a golf club head in accordance with an embodiment of the present disclosure.

An embodiment of the present disclosure will be explained below with reference to the accompanying drawings.

Note that like reference numerals refer to the like elements or parts throughout, and that redundant description of already described elements is omitted.

Figure 2:
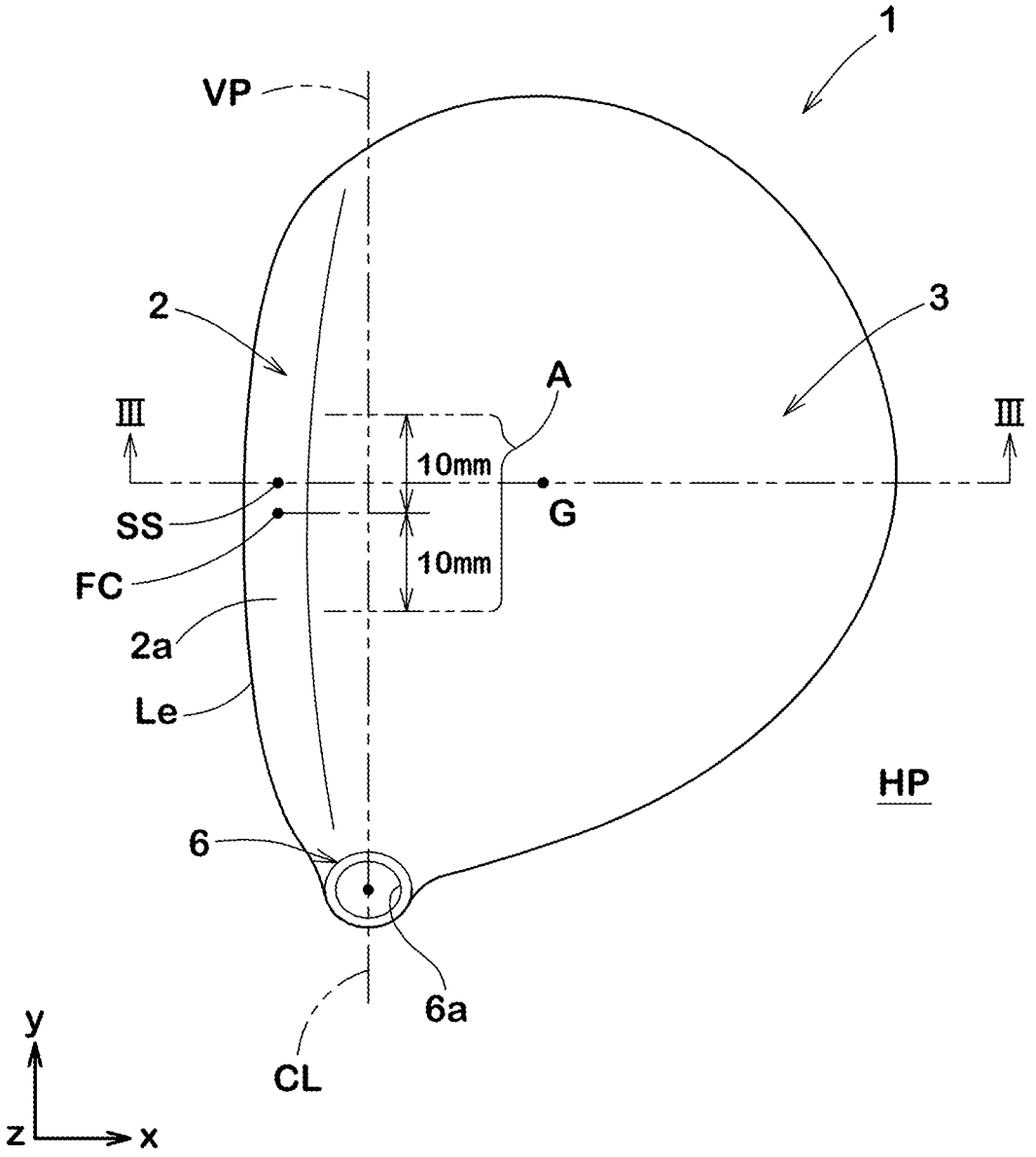
FIG. 2 is a plan view of the golf club head of FIG. 1.
Figure 3:
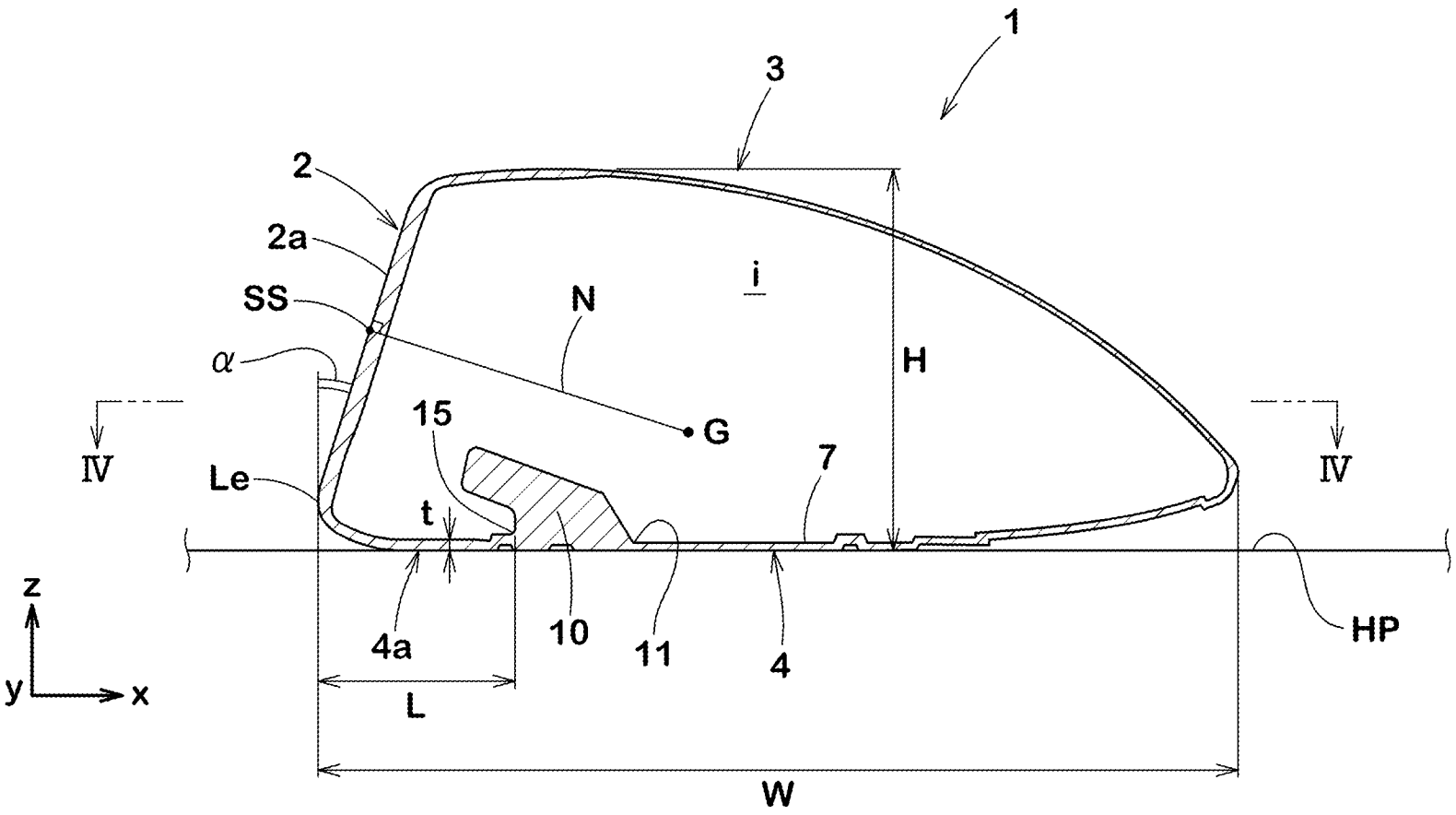
FIG. 3 is a cross-sectional view taken along line of FIG. 2.

FIG. 1 illustrates a perspective view of a golf club head (hereinafter may be simply referred to as "head") 1 in accordance with an embodiment, FIG. 2 illustrates a plan view thereof, and FIG. 3 illustrates a cross-sectional view taken along line III-III of FIG. 2.

[Standard State of Head]

In FIGS. 1 to 3, the head 1 in its standard state is shown. Unless otherwise noted, various dimensions and directions relating to the head 1 are described as being in the standard state.

The standard state of the head 1 is a state in which the head 1 is kept at its loft angle α (shown in FIG. 3) and lie angle (not shown) with respect to a horizontal plane HP. More specifically, the standard state, as shown in FIG. 2, is a state in which a club face 2*a* of the head 1 is kept its loft angle α (shown in FIG. 3) when a shaft center line CL of the head 1 is placed in a vertical plane VP with the lie angle.

Note that the shaft center line CL is defined as an axial center line of a shaft insertion hole 6*a* formed on a hosel portion 6 of the head 1.

[Coordinate System of Head]

In the present specification, an x-y-z coordinate system is defined for the head 1 where an x-axis is an axis orthogonal to the vertical plane VP and parallel to the horizontal plane HP, a y-axis is an axis parallel to both vertical plane VP and horizontal plane HP, and a z-axis is an axis orthogonal to both x-axis and y-axis.

Further, directions parallel to the x-axis, the y-axis and the z-axis are respectively defined as a head front-rear direction, a toe-heel direction, and a head up-down direction with respect to the head 1.

[Basic Embodiment of Head]

The head 1 according to the present embodiment is provided therein with a hollow portion i. Further, the head 1 according to the present embodiment is configured as a golf club head which is suitable for striking a ball placed directly on the ground. Such a golf club may include fairway woods or hybrids.

Typically, such a head has a loft angle $\alpha$ equal to or more than 15 degrees, a head volume of from about 100 cc to about 200 cc, a head weight of from about 190 g to about 240 g, and a head width W of from 60 to 90 mm.

Note that the head width W, as shown in FIG. 3, is a maximum length in the head front-rear direction of the head.

Further, as a golf club head which is suitable for striking a ball placed directly on the ground, the head 1 according to the present embodiment has a club head thickness H equal to or less than 39.0 mm.

The head thickness H is a height from the horizontal plane HP to the maximum height position of the head. This structure can provide a low center of gravity G, providing a low height of the sweet spot SS which is the intersection of the club face 2*a* and a normal line N drawn to the club face 2*a* from the center of gravity G of the head. This feature helps to improve repulsion performance of a lower position of the club face 2*a*.

Note that if the club head thickness H exceeds 39.0 mm, the location of sweet spot SS tends to be higher, and thus repulsion performance is prone to be deteriorated when striking a ball at a lower position of the club face 2*a*.

Fairway wood type golf club heads include club heads for at least spoon (#3), buffy (#4), clique (#5), other wood type golf clubs (#7 and #9) and the like.

Hybrids, for example, are well known in this technical field as a type of golf clubs with a design borrowing from both irons and woods.

The head 1 includes the face portion 2, a crown portion 3, a sole portion 4, and a side portion 5 which are arranged so as to define the hollow portion i.

For example, the hollow portion i may be a space as it is, or a part of the hollow portion i may be provided with gel composition for adjusting weight.

The face portion 2 forms a front wall of the head 1 to strike a ball, and has the club face 2*a* which is a surface directly in contact with a ball. The club face 2*a* is provided with a plurality of grooves called face lines (not illustrated) extending in the toe-heel direction.

Figure 9:
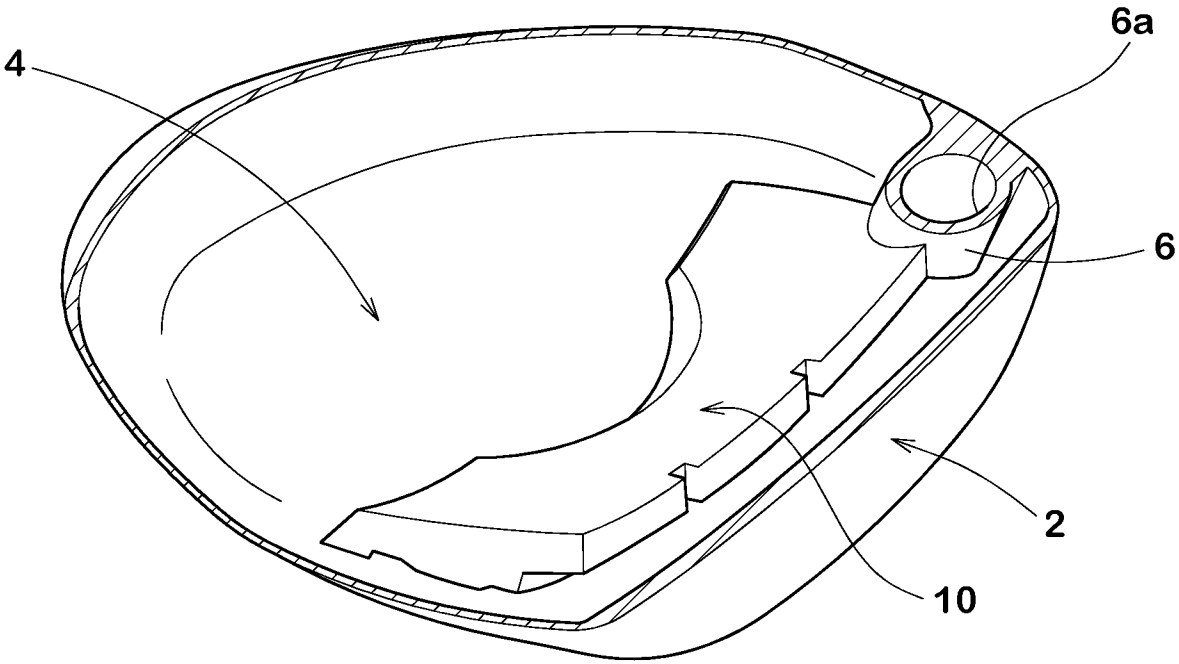
FIG. 9 is a cross-sectional view of the golf club head of FIG. 1.
Figure 10:
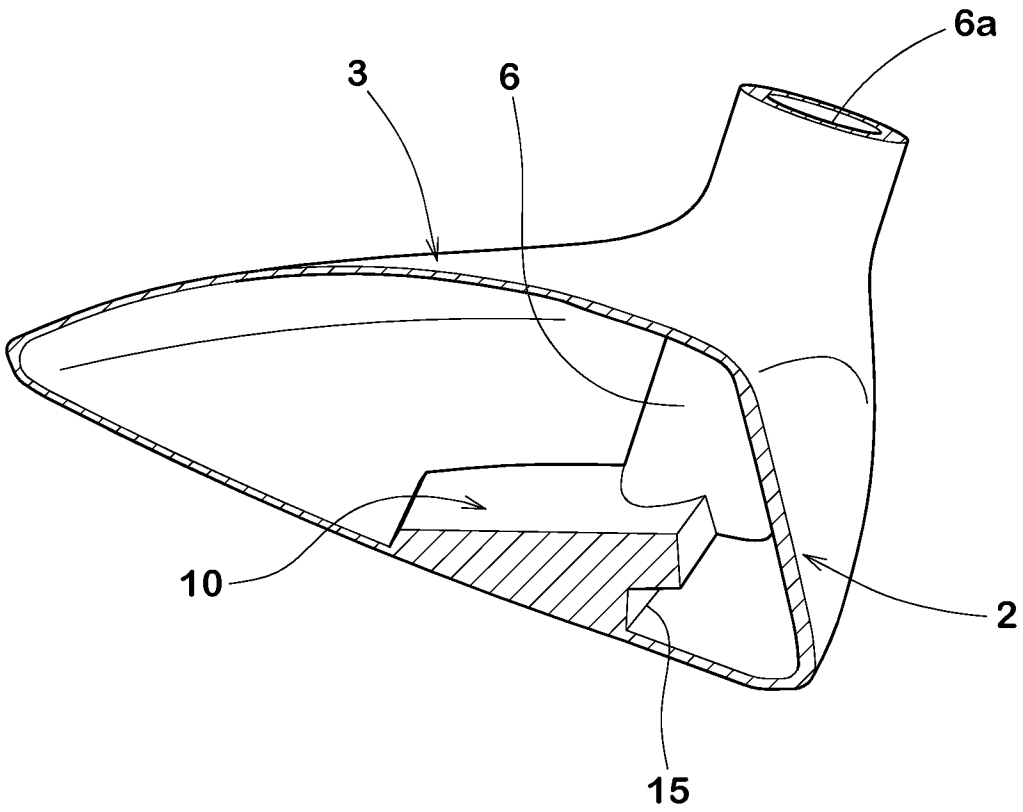
FIG. 10 is a cross-sectional view of the golf club head of FIG. 1.

The crown portion 3 extends rearwardly from an upper side of the face portion 2 and forms an upper surface of the head. The above-mentioned hosel portion 6 is provided in a heel side of the crown portion 3. The hosel portion 6 is formed in a cylindrical shape having the shaft insertion hole 6*a* into which a club shaft (not shown) is attached as shown, for example, in FIGS. 9 and 10.

The sole portion 4 extends rearwardly from a lower side of the face portion 2 and forms a bottom face of the head.

The side portion 5 connects the crown portion 3 and the sole portion 4. The toe side and the heel side of the side portion 5 are respectively connected to the toe side and the heel side of the face portion 2.

In the present embodiment, the face portion 2, the crown portion 3, the sole portion 4 and the side portion 5 are made of, for example, a metal material. As the metal material, for example, stainless steel, maraging steel, titanium alloy, magnesium alloy, aluminum alloy and the like can be preferably used. In another embodiment, a part of the head 1 (e.g. the crown portion 3) may be made of a non-metallic material such as fiber reinforced plastic and the like.

Figure 4:
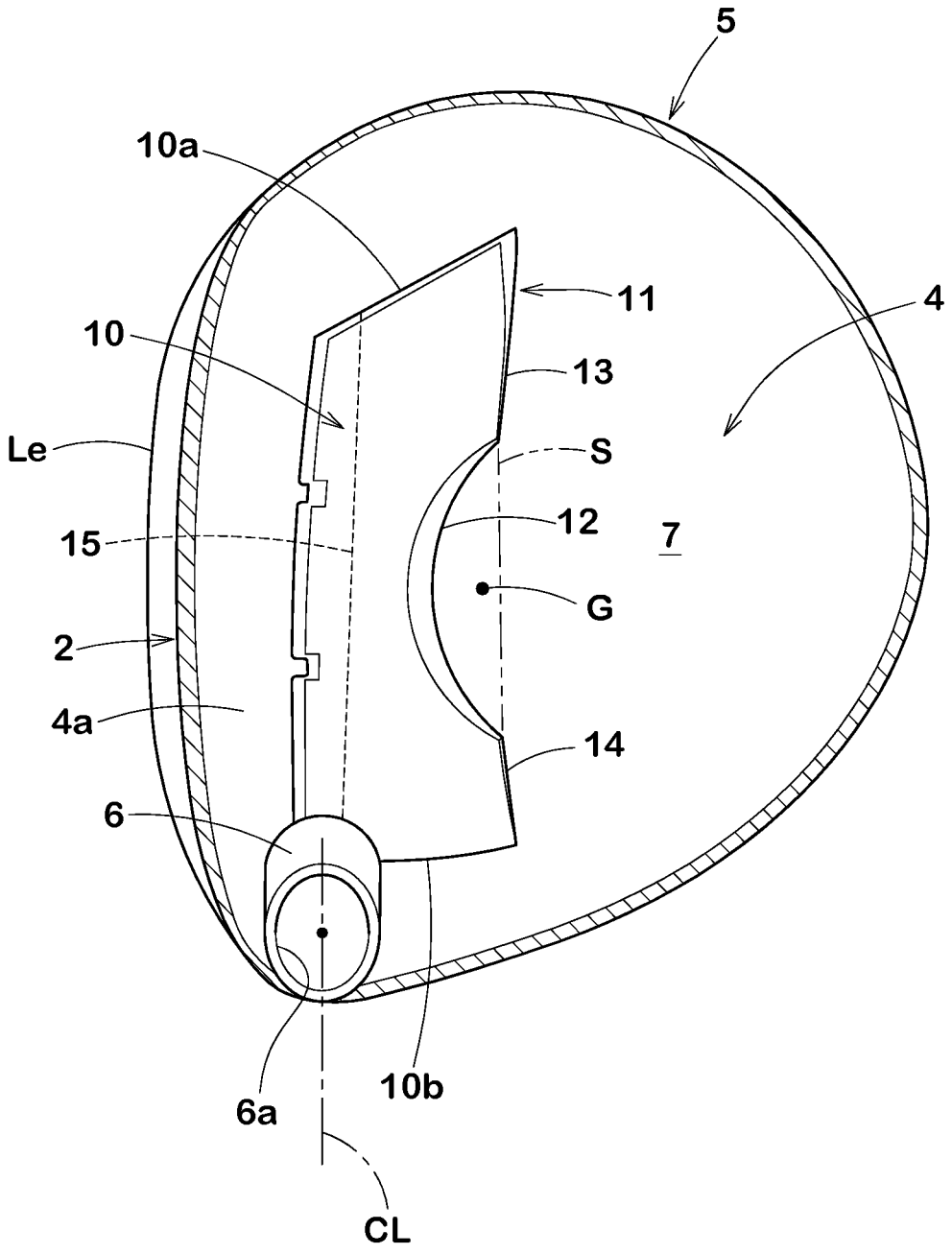
FIG. 4 is a cross-sectional view taken along line IV-IV of FIG. 3.
Figure 5:
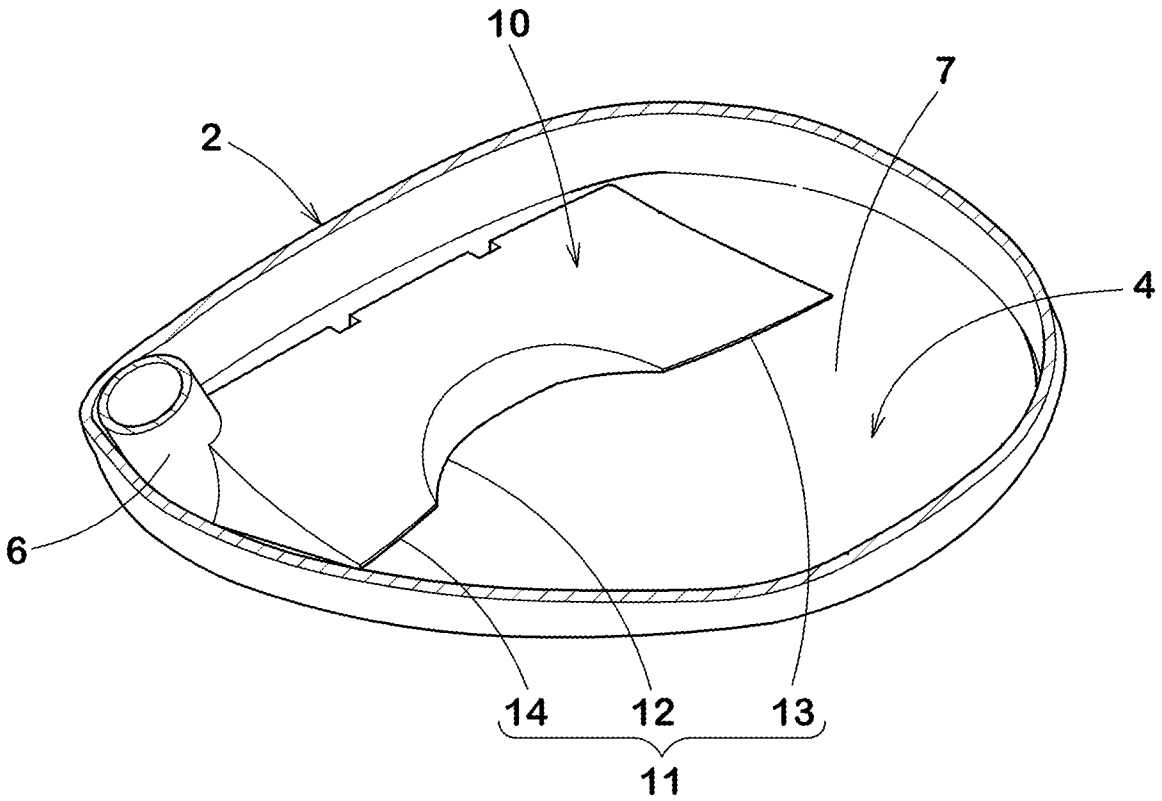
FIG. 5 is a perspective view of a sole portion of FIG. 4.

FIG. 4 illustrates a cross-sectional view taken along line IV-IV of FIG. 3, and FIG. 5 illustrates a perspective view of a portion of FIG. 4. As illustrated in FIGS. 3 to 5, an inner surface 7 of the sole portion 4 which faces the hollow portion i is provided with a weight portion (hereinafter referred to as "first weight portion") 10 extending along the leading edge like.

The first weight portion 10 is provided on the face portion 2 side in the head front-rear direction. As apparent from a cross-sectional view shown in FIG. 3, the first weight portion 10 according to the present embodiment extends upwardly from the inner surface 7 of the sole portion 4 such that the first weight portion 10 protrudes toward the face portion 2 without contacting with the face portion 2. More specifically, the first weight portion 10 according to the present embodiment extends upwardly from the inner surface 7 of the sole portion 4 at a location separated rearwardly from the face portion 2, and then extends obliquely toward the face portion 2 such that a tip end thereof terminates so as not in contact with the face portion 2 even upon hitting a ball.

In the present embodiment, the first weight portion 10 extends directly from the inner surface 7 of the sole portion 4. Thus, large weight is located on a lower side of the head and the face portion 2 side, enabling to provide a low sweet spot SS. Such a head 1, when striking a ball placed directly on the ground, can provide a sweet spot SS close to a striking position of the club face 2*a*, exerting high repulsion performance as well as low spin of a hit ball so that the distance increases.

In the present embodiment, the sole portion 4 includes a thin wall region 4*a* between the leading edge Le which is the forwardmost lower edge of the club face 2*a* extending in the toe-heel direction and the first weight portion 10, wherein the thin wall region 4*a* has a maximum thickness defined as "t" (mm). Further, the thin wall region 4*a* has a length L of from 14.0 to 23.0 mm in the head front-rear direction, and the thin wall region 4*a* has a ratio t-L of the maximum thickness t (mm) thereof to the length L (mm) is in a range of from 0.040 to 0.080.

The thin wall region 4*a* of the sole portion 4 tends to deform flexibly upon striking a ball, thus helping to improve repulsion performance of a lower position of the club face 2*a* further. When the head 1 has a so-called cup-face construction in which a cup shaped club face member and a head main body are welded, a weld bead may exist between the leading edge Le and the first weight portion 10. Such a weld bead has a large thickness unavoidably at least partially. In the present disclosure, the maximum thickness t (mm) is defined as a maximum thickness of a portion except such a weld bead.

The first weight portion 10 includes a front edge 15 defining a front end thereof. The front edge 15 of the first weight portion 10 is a front side connecting edge between the first weight portion 10 and the inner surface 7 of the sole portion 4. A portion of the sole portion 4 that is located between the leading edge Le and the first weight portion 10 is formed by the thin wall region 4*a*.

It is necessary for the thin wall region 4*a* to have the length L of from 14.0 to 23.0 mm in the head front-rear direction. For example, since a thickness of the face portion 2 tends to have a small thickness of from about 2 to 3 mm, in the present embodiment, the length L of the thin wall region 4*a* in the head front-rear direction is defined as a distance from the leading edge Le to the front edge 15 of the first weight portion 10 in the head front-rear direction for convenience sake. Since the head 1 according to the present embodiment has the length L of the thin wall region 4*a* equal to or more than 14.0 mm which is long enough, the sole portion 4 with the thin wall region 4*a* can be deform sufficiently when striking a ball on a lower position of the club face 2*a*. Further, since the length L of the thin wall region 4*a* is set equal to or less than 23.0 mm, it is possible that the first weight portion 10 is arranged close to the face portion 2. Thus, the head 1 can have low and shallow center of gravity G of the head, enabling to provide low sweet spot SS. Hence, the head 1, when striking a ball placed directly on the ground, can provide a sweet spot SS close to a striking position of the club face 2*a*, exerting high repulsion performance as well as low spin of a hit ball so that the distance increases.

Furthermore, in the present embodiment, the thin wall region 4*a* has a ratio t/L of the maximum thickness t (mm) thereof to the length L (mm) in a range of from 0.040 to 0.080.

The present disclosure pays attention to the ratio t/L of the maximum thickness t (mm) of the thin wall region 4*a* to the length L (mm) of the head front-rear direction while maintaining the length L of the thin wall region 4*a* in the head front-rear direction of from 14.0 to 23.0 mm. That is, in order to improve repulsion performance of the head 1, it is better that the maximum thickness t (mm) of the thin wall region 4*a* is as small as possible. However, if it makes the maximum thickness t smaller without considering the length L in the head front-rear direction, durability cannot be ensured. Thus, it is believed that an optimum value of the maximum thickness t of the thin wall region 4*a* to improve repulsion performance without deteriorating durability varies in accordance with the length L of the thin wall region 4*a* in the head front-rear direction.

In the present disclosure, based on the above basis, the ratio t/L is set in a range of from 0.040 to 0.080. Hence, in the head 1 with the length L of the thin wall region 4*a* in the head front-rear direction of from 14.0 to 23.0 mm, high repulsion performance can be exerted without deteriorating durability. Note that the maximum thickness t of the thin wall region 4*a* is not particularly limited as long as it satisfies the above range. Preferably, the maximum thickness t is in a range of from 0.6 to 1.8 mm, more preferably 0.6 to 1.4 mm, further preferably 0.6 to 1.1 mm.

As long as a value of the ratio t/L satisfies the above range, the ratio t/L may be constant in the toe-heel direction of the thin wall region 4*a*. Alternatively, a value of the ratio t/L may vary in the toe-heel direction of the thin wall region 4*a*. For example, a value of the ratio t/L of a middle region of the thin wall region 4*a* in the toe-heel direction is relatively large with respect to a predetermined value, and a value of the ratio t/L of toe and heel regions in the toe-heel direction of the thin wall region 4*a* is relatively small with respect to the predetermined value. Generally, repulsion performance of a club head tends to be small as far from the face center FC in the toe-heel direction. The head according to the above embodiment can help to prevent reduction of repulsion performance of the head since the ratio t/L becomes smaller as far from the face center FC in the toe-heel direction.

Further, it is preferable that the above-mentioned thin wall region 4*a* is formed in a certain region of the head 1 in the toe-heel direction. In some preferred embodiments, as shown in a plan view of FIG. 2, the thin wall region 4*a* satisfying the above the range of the ratio t/L preferably forms at least a region A which has 10 mm from the face center FC on both toe and heel sides. Thus, the above effect can be ensured further over a wide hitting region. Note that the face center FC is a point on the club face 2*a* which is located the center of the club face 2*a* in both toe-heel direction and head up-down direction.

As illustrated in FIG. 4, the first weight portion 10 according to the present embodiment includes a toe-side end 10*a* located on the toe-side with respect to the center of gravity G of the head, and a heel-side end 10*b* located on the heel side with respect to the center of gravity G of the head. Further, the toe-side end 10*a* of the first weight portion 10, for example, terminates so as not to reach the side portion 5, and the heel-side end 10*b* of the first weight portion 10, for example, is connected to the hosel portion 6.

A height and a location in the head front-rear direction of the center of gravity G of the head can be optimized by adjusting volume and/or the cross-sectional shape of the first weight portion 10. For example, a gravity height from the horizontal plane HP to the center of gravity G of the head is preferably in a range of from 11 to 16 mm. In addition, a gravity depth which is a distance in the head front-rear direction from the leading edge Le of the head 1 to the center of gravity G of the head is preferably in a range of from 29 to 32 mm. Furthermore, a height of the sweet spot SS of the head 1 from the horizontal plane HP, for example, is equal to or less than 22 mm, more preferably from 17 to 22 mm. These features can provide a low sweet spot SS close to a striking point when the club head 1 strikes a ball placed directly on the ground, increasing a distance of a hit ball.

As illustrated in FIG. 4 and FIG. 5, the first weight portion 10 includes a rear edge 11 defining a rear end thereof in the head front-rear direction. The rear edge 11 is a rear connecting edge between the first weight portion 10 and the inner surface of the sole portion 4. In other words, in a cross-sectional view of FIG. 3 as well as cross-sectional views parallel to FIG. 3 of the first weight portion 10, the rear edge 11 defines a rear end of the first weight portion 10 in the head front-rear direction.

As apparent from FIG. 4, the first weight portion 10 is located on the front side with respect to the rear edge 11. In some preferred embodiments, in a plan view of the sole portion 4, the rear edge 11 of the first weight portion 10 includes a concave edge 12 which is concave toward the face portion 2, and the center of gravity G of the head is located rearwardly of the concave edge 12. Since the above embodiment can allocate weight of the first weight portion 10 away from the center of gravity G of the head, the head 1 can provide large moment of inertia around the z-axis passing through the center of gravity G of the head 1 (hereinafter, simply referred to as "moment of inertia around the z-axis"), improving directionality of a hit ball.

In some preferred embodiment, in a plan view of the sole portion 4, the concave edge 12 is a circular arc shape having the center located rearwardly of the concave edge 12. This embodiment can optimize the above weight allocation effect, increasing moment of inertia around the z-axis further. Note that the "circular arc shape" includes not only a single radius circular arc shape but also a multiple circular arc shape including a plurality of circular arc shape connected with one another (the same hereinafter).

In some preferred embodiments, in a plan view of the sole portion 4, the center of gravity G of the head may be located within a concave area which is surrounded by the concave edge 12 and a straight-line S connecting both ends in the toe-heel direction of the concave edge 12. Thus, moment of inertia around the z-axis of the head can further be increased while approaching the center of gravity G of the head to the face portion 2.

In some preferred embodiments, moment of inertia of the head 1 around the z-axis is preferably in a range of from 2200 to 2800 $g \cdot cm^2$. Thus, directionality of a hit ball can be improved further.

In the present embodiment, the rear edge 11 of the first weight portion 10, for example, includes a toe-side edge 13 and a heel side edge 14 between which the concave edge 12 is located, and the toe-side edge 13 and the heel side edge 14 extend in substantially parallel with the toe-heel direction. Note that the "substantially" parallel shall mean that the toe-side edge 13 and the heel side edge 14 extend within 10 degrees with respect to the toe-heel direction. These toe-side edge 13 and heel-side edge 14 can allocate more weight to toe and heel sides in the head 1, helping to increase moment of inertia around the x-axis.

[Manufacturing Method of First Weight Portion]

The first weight portion 10, for example, may be formed integrally with the sole portion 4 previously by casting, cutting and the like. In the present embodiment, the first weight portion 10 is formed by a thick wall portion of the sole portion 4. Thus, the first weight portion 10 is made of the same metallic material as that of the sole portion 4.

[Other Embodiments of First Weight Portion]

Figure 6A:
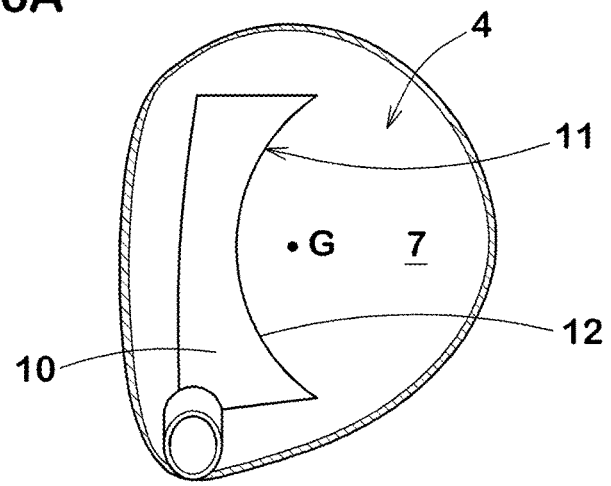
FIGS. 6A to 6C are plan views of sole portions in accordance with other embodiments.
Figure 6B:
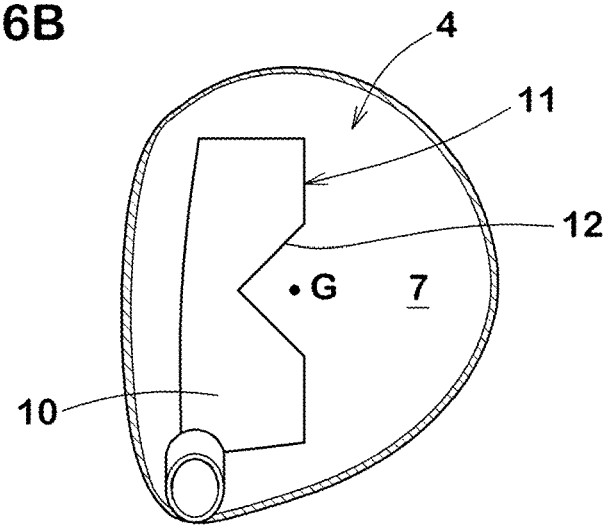
Figure 6C:
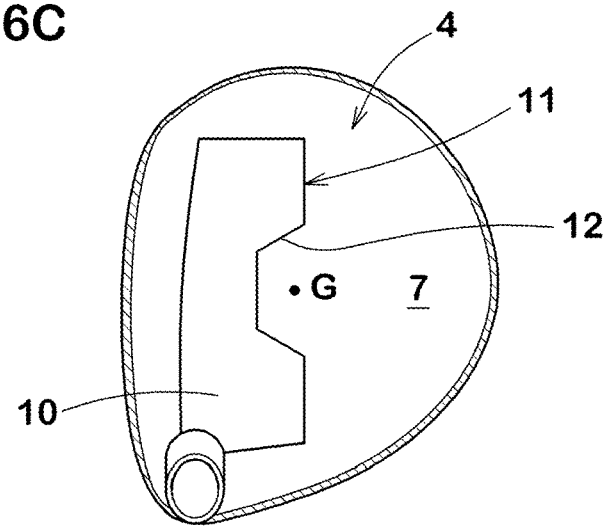

FIGS. 6A to 6C are plan views of the inner surfaces 7 of the respective sole portions 4 in accordance with other embodiments for the first weight portion 10. As illustrated in FIG. 6A, the entire rear edge 11 of the first weight portion 10 may be formed by the concave edge 12 from the toe-side end to the heel side end. Further, as illustrated in FIGS. 6B and 6C, the concave edge 12 may be formed by a combination of straight edges. That is, FIG. 6B shows that the concave edge 12 is a polygonal line forming a V-shaped concave edge, and FIG. 6C shows that the concave edge 12 is a polygonal line forming a trapezoidal concave shape.

Figure 7:
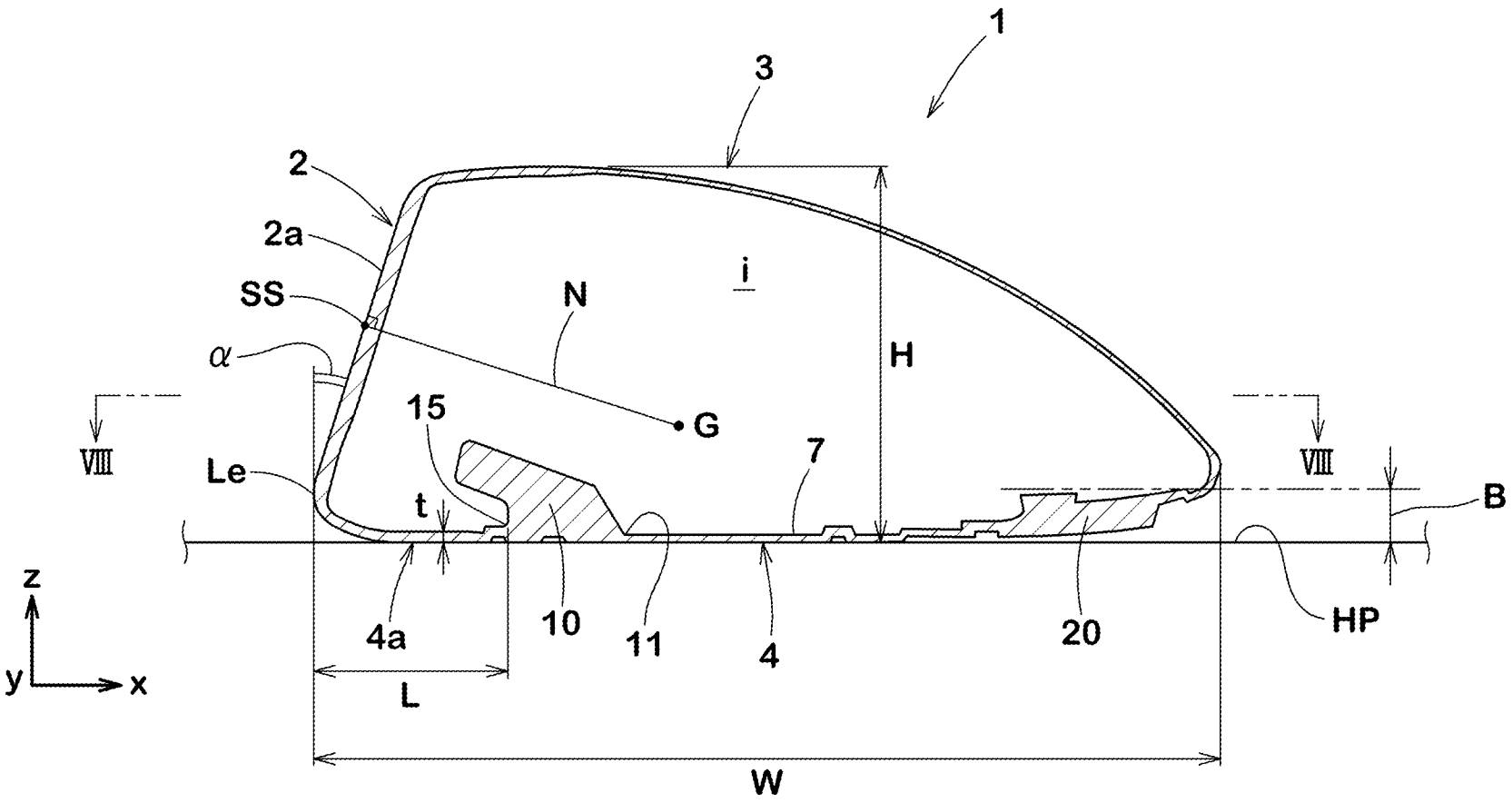
FIG. 7 is a cross-sectional view of a golf club head in accordance with another embodiment of the disclosure and which corresponds to a cross-section taken along line III-III of FIG. 2.

Next, another embodiment of the sole portion 4 will be explained based on FIG. 7 and FIG. 8. FIG. 7 illustrates a cross-sectional view of the head 1 in accordance with another embodiment of the disclosure and which corresponds to a cross-section taken along line III-III of FIG. 2. Further, FIG. 8 illustrates a cross-sectional view taken along line VIII-VIII of FIG. 7.

[Second Weight Portion]

Figure 8:
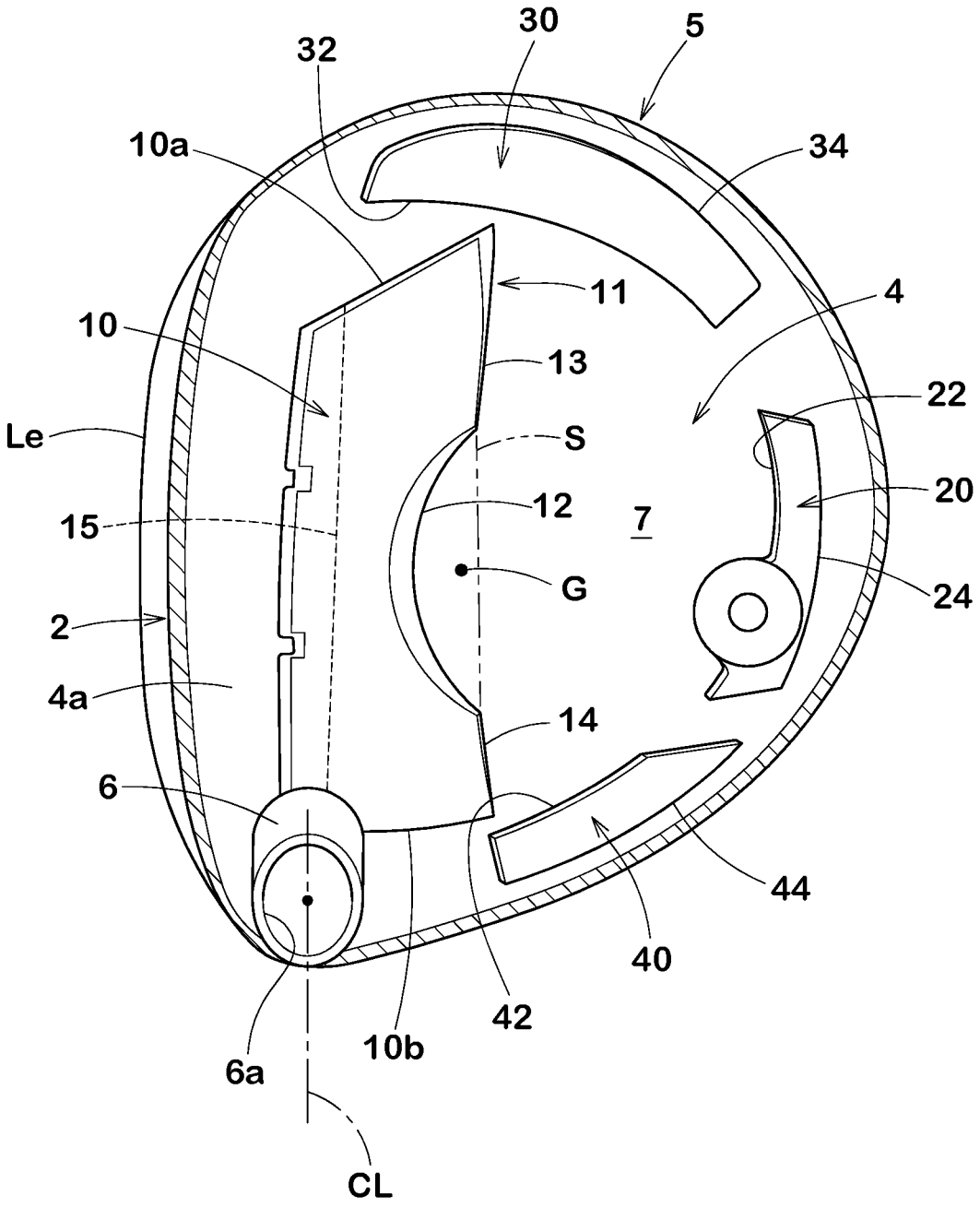
FIG. 8 is a cross-sectional view taken along line VIII-VIII of FIG. 7.

As illustrated in FIG. 7 and FIG. 8, the inner surface 7 of the sole portion 4 may be provided with a second weight portion 20 which is located rearwardly of the center of gravity G of the head. The second weight portion 20 can allocate more weight convergently to rearward in the sole portion 4, making the center of gravity depth of the head 1 deeper while maintaining low center of gravity G of the head 1. Further, the second weight portion 20 can help to increase moment of inertia around the z-axis.

In the present embodiment, the second weight portion 20 is configured as a localized thick wall portion of the sole portion 4 which is thicker than the maximum thickness t of the thin wall region 4*a*. Although a thickness of the second weight portion 20 is not particularly limited, the thickness is preferably equal to or more than 1.4 mm, more preferably equal to or more than 1.8 mm. Thus, the second weight portion 20 can allocate weight convergently in the sole portion 4, improving the above effect. Alternatively, the second weight portion 20 may be configured as a weight made of a different metallic material from that of the sole portion 4.

In some preferred embodiments, as illustrated in FIG. 7, the second weight portion 20 is arranged within a region (B) which has a height equal to or less than 6 mm from the horizontal plane HP. Generally, the sole portion 4 has a shape curving upwardly toward rearward of the head. Thus, if the second weight portion 20 is arranged rearward of the head nearby, there is a risk that the location of center of gravity G of the head becomes high. By providing the second weight portion 20 within the above-mentioned region (B), such a risk can be avoided.

In a plan view of the sole portion 4 as illustrated in FIG. 8, the second weight portion 20 includes a front edge 22 which is a connecting edge between the second weight portion 20 and the inner surface 7 of the sole portion 4 on a side of the center of gravity G of the head. In some preferred embodiments, the front edge 22 is curved in a circular arc shape having the center in a side of the center of gravity G of the head. In the embodiment, weight of the second weight portion 20 can be allocated to a location of the sole portion farther from the center of gravity G of the head, optimizing the above-mentioned weight allocation effect, improving moment of inertia around the z-axis further.

In this embodiment, in a plan view of the sole portion 4, the second weight portion 20 includes a rear edge 24 which is a connecting edge between the second weight portion 20 and the inner surface 7 of the sole portion 4 on a side of a rearward contour of the head 1. In this embodiment, the rear edge 24 is also curved in a circular arc shape having the center in a side of the center of gravity G of the head. More specifically, the rear edge 24 of the second weight portion 20, in a plan view of the head, extends along the rearward contour of the head 1. Thus, the second weight portion 20 can allocate more weight to a periphery of the rearward contour of the head.

[Third Weight Portion]

As illustrated in FIG. 8, the inner surface 7 of the sole portion 4 may be provided with a third weight portion 30 located on toe side of the head with respect to the center of gravity G of the head. The third weight portion 30 can allocate more weight convergently to toe side in the sole portion 4, helping to increase moment of inertia around the z-axis while maintaining low center of gravity G of the head.

In this embodiment, the third weight portion 30 is configured as a localized thick wall portion of the sole portion 4 which is thicker than the maximum thickness t of the thin wall region 4*a*. Although a thickness of the third weight portion 30 is not particularly limited, the thickness is preferably equal to or more than 1.0 mm, more preferably equal to or more than 1.3 mm. Thus, weight of the third weight portion 30 can be allocated convergently to toe side in the sole portion 4, improving the above-mentioned effect. Alternatively, the third weight portion 30 may be configured as a weight made of a different metallic material from that of the sole portion 4.

The third weight portion 30, for example, is provided away from the first weight portion 10 and the second weight portion 20. In other words, a portion that has a thickness thinner than those of the first, second and third weight portions 10, 20 and 30 is provided between the third weight portion 30 and the first weight portion 10, as well as between the third weight portion 30 and the second weight portion 20. Thus, the head 1 can prevent excessive increase of stiffness of the sole portion 4, preventing deterioration of repulsion performance.

In a plan view of the sole portion 4, the third weight portion 30 includes an inner edge 32 which is a connecting edge between the third weight portion 30 and the inner surface 7 of the sole portion 4 on a side of the center of gravity G of the head. In some preferred embodiments, the inner edge 32 of third weight portion 30 is curved in a circular arc shape having the center in a side of the center of gravity G of the head. In the embodiment, weight of the third weight portion 30 can be allocated to a location of the sole portion farther from the center of gravity G of the head, optimizing the above-mentioned weight allocation effect, improving moment of inertia around the z-axis further.

In this embodiment, in a plan view of the sole portion 4, the third weight portion 30 further includes an outer edge 34 which is a connecting edge between the third weight portion 30 and the inner surface 7 of the sole portion 4 on a side of a toe-side contour of the head 1. The outer edge 34 of the third weight portion 30 is also curved in a circular arc shape having the center in a side of the center of gravity G of the head. More specifically, the outer edge 34 of the third weight portion 30 extends along the toe-side contour of the head 1. Thus, the third weight portion 30 can allocate more weight to a periphery of toe-side in the sole portion 4 effectively.

[Fourth Weight Portion]

As illustrated in FIG. 8, the inner surface 7 of the sole portion 4 may be provided with a fourth weight portion 40 on heel side with respect to the center of gravity G of the head. The fourth weight portion 40 can allocate more weight convergently to heel side in the sole portion 4, helping to increase moment of inertia around the z-axis while maintaining low center of gravity G of the head.

In the present embodiment, the fourth weight portion 40 is configured as a localized thick wall portion of the sole portion 4 which is thicker than the maximum thickness t of the thin wall region 4*a*. Although a thickness of the fourth weight portion 40 is not particularly limited, the thickness is preferably equal to or more than 1.2 mm, more preferably equal to or more than 1.5 mm. Thus, the fourth weight portion 40 can allocate weight convergently in the sole portion 4, improving the above effect. Alternatively, the fourth weight portion 40 may be configured as a weight made of a different metallic material from that of the sole portion 4.

The fourth weight portion 40, for example, is provided away from the first weight portion 10 and the second weight portion 20. In other words, a portion that has a thickness thinner than those of the first, second and fourth weight portions 10, 20 and 40 is provided between the fourth weight portion 40 and the first weight portion 10, as well as between the fourth weight portion 40 and the second weight portion 20. Thus, the head 1 can prevent excessive increase of stiffness of the sole portion 4, preventing deterioration of repulsion performance.

In a plan view of the sole portion 4, the fourth weight portion 40 includes an inner edge 42 which is a connecting edge between the fourth weight portion 40 and the inner surface 7 of the sole portion 4 on a side of the center of gravity G of the head. In some preferred embodiments, the inner edge 42 of fourth weight portion 40 is curved in a circular arc shape having the center in a side of the center of gravity G of the head. In the embodiment, weight of the fourth weight portion 40 can be allocated to a location of the sole portion farther from the center of gravity G of the head, optimizing the above-mentioned weight allocation effect, improving moment of inertia around the z-axis further.

In a plan view of the sole portion 4, the fourth weight portion 40 further includes an outer edge 44 which is a connecting edge between the fourth weight portion 40 and the inner surface 7 of the sole portion 4 on a side of a heel-side contour of the head. The outer edge 44 of the fourth weight portion 40 is also curved in a circular arc shape having the center on the side of the center of gravity G of the head. More specifically, the outer edge 44 of the fourth weight portion 40 extends along the heel-side contour of the head 1. Thus, the fourth weight portion 40 can allocate more weight to a periphery of heel side of the sole portion 4 effectively.

[Combination of Weight Portions]

In the embodiment shown in FIG. 8, the sole portion 4, in addition to the first weight portion 10, is provided with the second weight portion 20, the third weight portion 30 and the fourth weight portion 40. However, the second weight portion 20, the third weight portion 30 and the fourth weight portion 40 are arbitrary elements, and thus all of them may be removed. Further, regarding the second weight portion 20, the third weight portion 30 and the fourth weight portion 40, either one of them may be provided, or two or more which are selected arbitrarily from among them may be provided. Furthermore, the third weight portion 30, for example, is preferably greater than the second weight portion 20 and the fourth weight portion 40. Thus, more weight can be allocated to the opposite position to the hosel portion 6, helping to optimize weight balance of the head.

While the particularly preferred embodiments in accordance with the disclosure have been described in detail above, the present disclosure is not limited to the above embodiments but can be modified and carried out in various aspects within the scope of the disclosure.

Example

Hollow fairway wood type golf club heads (#3) shown in FIGS. 1 to 5 were manufactured by way of trial based on specifications as shown in Table 1 (examples and comparative examples). The heads were adjusted in the respective head width such that each club has head volume of 200 cc. Then, the heads of examples and comparative examples were tested on sweet spot height, repulsion performance and durability.

As to repulsion performance of the heads, in order to evaluate repulsion performance of the head when striking a ball placed directly on the ground, a ratio of COR (coefficient of restitution) on a lower position of the club face to COR on the center of the club face was used. Here, the lower position of the club face is a position that is located on a vertical line passing through the face center and that is located 16 mm above from the horizontal surface on which the club head under the standard state is placed. Note that this position is below the face center as well as the sweet spot. Repulsion performance becomes smaller as it goes away from the face center. Thus, a value of the ratio being closer to 1 indicates better repulsion performance at the lower position of the club face. Note that COR of the respective striking positions were measured according to the procedure specified by "Procedure for Measuring the Velocity Ratio of a Club Head for Conformance to Rule 4-1e, Revision 2 (Feb. 8, 1999)" of the United States Golf Association.

As to durability of the heads, the respective club head were attached to the same golf shafts to construct golf clubs, and then, a striking test was conducted using a swing robot such that each golf club strikes balls repeatedly at head-speed of 47 m/s. Then, while checking status of club heads every one hundred striking, the number of striking of each golf club until damage occurs on the club face and/or a periphery of the club face was measured. The test results are shown in Table 1.

TABLE 1

| | Ref. 1 | Ex. 1 | Ex. 2 | Ref. 2 | Ex. 3 | Ex. 4 | Ref. 3 | Ex. 5 | Ref. 4 | Ref. 5 | Ex. 6 |
|---|---|---|---|---|---|---|---|---|---|---|---|
| Length L in head front-rear direction of thin wall region (mm) | 12.0 | 15.0 | 15.0 | 18.0 | 18.0 | 18.0 | 18.0 | 21.0 | 18.0 | 25.0 | 18.0 |
| Maximum thickness t of thin wall region (mm) | 1.2 | 0.6 | 0.8 | 0.6 | 0.8 | 1.0 | 1.5 | 0.9 | 0.8 | 0.8 | 1.4 |
| Ratio t/L | 0.100 | 0.040 | 0.053 | 0.033 | 0.044 | 0.056 | 0.083 | 0.043 | 0.044 | 0.032 | 0.078 |
| Head thickness H (mm) | 36.0 | 36.0 | 36.0 | 36.0 | 36.0 | 36.0 | 36.0 | 36.0 | 40.0 | 36.0 | 36.0 |
| Sweet spot height (mm) | 20.5 | 21.0 | 21.0 | 21.0 | 21.0 | 21.0 | 21.0 | 21.5 | 22.0 | 22.5 | 21.0 |
| Repulsion performance | 0.950 | 0.980 | 0.975 | 0.990 | 0.985 | 0.980 | 0.960 | 0.990 | 0.950 | 0.991 | 0.970 |
| Durability (number of striking) | 20500 | 10000 | 12000 | 8000 | 11000 | 12000 | 23000 | 10500 | 11000 | 9500 | 21000 |

From the test results, it is confirmed that the club heads of examples provide low sweet spot and high repulsion performance.

What is claimed is:

1. A golf club head having a hollow portion therein, the golf club head comprising:

a face portion for striking a ball, the face portion defining a leading edge;

a crown portion (3) forming an upper surface of the club head;

a sole portion extending rearwardly of the club head from the face portion, the sole portion having an inner surface thereof facing the hollow portion;

a club head thickness, measured from a bottom face of the sole portion to the crown portion in a vertical direction, being equal to or less than 39.0 mm; and a hosel portion consisting of a cylindrical portion having a shaft insertion hole to accommodate a club shaft; wherein the sole portion is provided on the inner surface with a first weight portion extending along and offset from the leading edge and a thin wall region between the leading edge and the first weight portion, the thin wall region has a length L of from 14.0 to 23.0 mm in a head front-rear direction, the thin wall region, in at least a region that extends from a center of the face portion to both a toe side and a heel side of the center of the face portion, has a ratio t/L of a maximum thickness t (mm) thereof to the length L (mm) that is in a range of from 0.040 to 0.080, the first weight portion has a toe-side end located on a toe-side with respect to a center of gravity G of the head, and a heel-side end located on a heel side with respect to the center of gravity of the head, the first weight portion has a front edge defining a front end thereof, the front edge is a front side connecting edge between the first weight portion and the inner surface of the sole portion, the first weight portion is directly connected to the hosel portion, and the heel-side end of the first weight portion extends backwardly from the hosel portion.

2. The golf club head according to claim 1, wherein the maximum thickness t of the thin wall region is in a range of from 0.6 to 1.8 (mm).

3. The golf club head according to claim 1, wherein the maximum thickness t of the thin wall region is in a range of from 0.6 to 1.4 mm.

4. The golf club head according to claim 1, wherein the maximum thickness t of the thin wall region is in a range of from 0.6 to 1.1 mm.

5. The golf club head according to claim 1, wherein the first weight portion extends upwardly from the inner surface of the sole portion such that the first weight portion protrudes toward the face portion without contacting with the face portion.

6. The golf club head according to claim 5, further comprising a side portion extending between the crown portion and the sole portion, wherein the toe-side end terminates so as not to reach the side portion.

7. The golf club head according to claim 6, wherein the front side connecting edge of the first weight portion has a toe-side edge end, and the toe-side end of the first weight portion extends backwardly of the club head from the toe-side edge end of the front side connecting edge of the first weight portion with an inclination toward a toe-side of the head.

8. The golf club head according to claim 1, wherein the first weight portion is formed by a thick wall portion of the sole portion.

9. The golf club head according to claim 1, wherein the golf club head has a weight of from 190 to 240 g.

10. The golf club head according to claim 1, wherein the golf club head has a head width which is a maximum length in the head front-rear direction of the club head is in a range of from 60 to 90 mm.

11. The golf club head according to claim 1, wherein
the golf club head has a sweet spot height equal to or less than 22 mm, the sweet spot being an intersection of a club face of the golf club head and a normal line drawn to the club face from the center of gravity of the head.

12. The golf club head according to claim 1, wherein
the length L is from 18.0 to 23.0 mm.

13. The golf club head according to claim 1, wherein
the first weight portion comprises a rear edge defining a rear end thereof in the head front-rear direction,
the rear edge comprises a concave edge which is concave toward the face portion, and
the center of gravity of the head is located rearwardly of the concave edge.

14. The golf club head according to claim 13, wherein
the concave edge is a circular arc shape having a center thereof located rearwardly of the concave edge.

15. The golf club head according to claim 14, wherein
the center of gravity of the head is located within a concave area which is surrounded by the concave edge and an imaginary straight-line connecting both ends in the toe-heel direction of the concave edge.

16. The golf club head according to claim 1, wherein
the first weight portion is located forwardly of the center of gravity of the head,
the sole portion is provided with a second weight portion which is located rearwardly of the center of gravity of the head, and
the second weight portion is formed by a thick wall portion of the sole portion having a thickness greater than the maximum thickness of the thin wall region.

17. The golf club head according to claim 16, wherein
the sole portion is provided with a third weight portion which is located toe side with respect to the center of gravity of the head, and
the third weight portion is formed by a thick wall portion of the sole portion having a thickness greater than the maximum thickness of the thin wall region.

18. The golf club head according to claim 17, wherein
the sole portion is provided with a fourth weight portion which is located heel side with respect to the center of gravity of the head, and
the fourth weight portion is formed by a thick wall portion of the sole portion having a thickness greater than the maximum thickness of the thin wall region.

19. The golf club head according to claim 18, wherein
the first weight portion, the second weight portion, the third weight portion and the fourth weight portion are arranged separately from one another through a portion having a thickness smaller than those of the first weight portion, the second weight portion, the third weight portion and the fourth weight portion.

20. The golf club head according to claim 16, wherein
the sole portion is provided with a fourth weight portion which is located heel side with respect to the center of gravity of the head, and
the fourth weight portion is formed by a thick wall portion of the sole portion having a thickness greater than the maximum thickness of the thin wall region.

21. The golf club head according to claim 1, wherein
the sole portion includes a first weight portion, a second weight portion, a third weight portion, and a fourth weight portion, the third weight portion being heavier than the second weight portion and the third weight portion being heavier than the fourth weight portion, and
the first weight portion is provided on the inner surface of the sole portion.

22. The golf club head according to claim 1, wherein
an axial center line of the shaft insertion hole defines a shaft centerline of the golf club head, and
in a plan view of the golf club head, the front side connecting edge of the first weight portion is located rearwardly of the shaft centerline.

* * * * *